United States Patent [19]

Lambert

[11] 4,282,306

[45] Aug. 4, 1981

[54] DYE DEVELOPER PROCESSES

[75] Inventor: Ronald F. Lambert, Wayland, Mass.

[73] Assignee: Polaroid Corporation, Cambridge, Mass.

[21] Appl. No.: 143,283

[22] Filed: Apr. 24, 1980

Related U.S. Application Data

[63] Continuation-in-part of Ser. No. 32,954, Apr. 24, 1979, abandoned.

[51] Int. Cl.[3] ..... G03C 1/40; G03C 5/54; G03C 7/00; G03C 5/30

[52] U.S. Cl. ..... 430/218; 430/239; 430/446; 430/469; 430/487

[58] Field of Search ..... 430/218, 219, 239, 240, 430/446, 469, 486, 487

[56] References Cited

U.S. PATENT DOCUMENTS

| | | | |
|---|---|---|---|
| 3,353,956 | 11/1967 | Rogers et al. | 430/218 |
| 3,377,166 | 4/1968 | Weyerts et al. | 430/218 |
| 3,474,098 | 10/1969 | Hitchings et al. | 260/256.5 |
| 3,649,265 | 3/1972 | Stewart | 430/218 |
| 3,785,814 | 1/1974 | Land et al. | 430/218 |
| 3,899,331 | 8/1975 | Bloom et al. | 430/219 |
| 4,095,982 | 6/1978 | Yoneyama et al. | 430/469 |
| 4,102,684 | 7/1978 | Greenwald | 430/218 |
| 4,147,543 | 4/1979 | Kubotera et al. | 430/486 |

OTHER PUBLICATIONS

*1981–1982 Aldrich Cat. Handbook of Fine Chemicals,* Cat. 20, Aldrich Chem. Co., Milwaukee, Wis., 1980, p. 111.

"The Nitrosation of . . . Derivatives", Freeman et al., *J. Org. Chem.* (1969), vol. 34 pp. 187–194.

*Eastman Kodak Chem. Cat.,* No. 50, p. 147.

*Primary Examiner*—Richard L. Schilling

*Attorney, Agent, or Firm*—Stanley H. Mervis

[57] ABSTRACT

Diffusion transfer color processes employing dye developers have been found to give improved results by the inclusion in the processing composition of a 5- or 6-membered aromatic unsaturated diazole free of imino nitrogen atoms.

21 Claims, No Drawings

DYE DEVELOPER PROCESSES

This application is a continuation-in-part of copending application Ser. No. 32,954 filed Apr. 24, 1979 (now abandoned).

This invention relates to photography and, more particularly, to diffusion transfer photography.

U.S. Pat. No. 2,983,606, issued May 9, 1961 to Howard G. Rogers, a photosensitive element containing a dye developer and a silver halide emulsion is photoexposed and a processing composition applied thereto, for example, by immersion, coating, spraying, flowing, etc., in the dark. The exposed photosensitive element is superposed prior to, during, or after the processing composition is applied, on a second sheet-like element which may be utilized as an image-receiving element. In a preferred embodiment, the processing composition is applied to the exposed photosensitive element in a substantially uniform layer as the photosensitive element is brought into superposed relationship with an image-receiving layer carried by said second sheet-like element. The processing composition permeates the emulsion to initiate development of the latent image contained therein. The dye developer is immobilized or precipitated in exposed areas as a consequence of the development of the latent image. This immobilization is apparently, at least in part, due to a change in the solubility characteristics of the dye developer upon oxidation and especially as regards its solubility in alkaline solutions. It may also be due in part to a tanning effect on the emulsion by oxidized developing agent, and in part to a localized exhaustion of alkali as a result of development. In unexposed and partially exposed areas of the emulsion, the dye developer is unreacted and diffusible and thus provides an imagewise distribution of unoxidized dye developer, diffusible in the processing composition, as a function of the point-to-point degree of exposure of the silver halide emulsion. At least part of this imagewise distribution of unoxidized dye developer is transferred, by imbibition, to the superposed image-receiving layer, said transfer substantially excluding oxidized dye developer. The image-receiving layer receives a depthwise diffusion, from the developed emulsion, of unoxidized dye developer without appreciably disturbing the imagewise distribution thereof to provide a reversed or positive color image of the developer image. The image-receiving element may contain agents adapted to mordant or otherwise fix the diffused, unoxidized dye developer. In a preferred embodiment of said U.S. Pat. No. 2,983,606 and in certain commercial applications thereof, the desired positive image is revealed by separating the image-receiving element from the photosensitive element at the end of a suitable imbibition period. Alternatively, as also disclosed in said U.S. Pat. No. 2,983,606, the image-receiving layer need not be separated from its superposed contact with the photosensitive element, subsequent to transfer image formation, if the support for the image-receiving layer, as well as any other layers intermediate said support and image-receiving layer, is transparent and a processing composition containing a substance, e.g., a white pigment, effective to mask the developed silver halide emulsion or emulsions, is applied between the image-receiving layer and said silver halide emulsion or emulsions.

Dye developers, as noted in said U.S. Pat. No. 2,983,606, are compounds which contain, in the same molecule, both the chromophoric system of a dye and also a silver halide developing function. By "a silver halide developing function" is meant a grouping adapted to develop exposed silver halide. A preferred silver halide development function is a hydroquinonyl group. In general, the development function includes a benzenoid developing function, that is, an aromatic developing group which forms quinonoid or quinone substances when oxidized.

Multicolor images may be obtained using dye developers in diffusion transfer processes by several techniques. One such technique contemplates obtaining multicolor transfer image utilizing dye developers by employment of an integral multilayer photosensitive element, such as is disclosed in the aforementioned U.S. Pat. No. 2,983,606 and in U.S. Pat. No. 3,345,163 issued Oct. 3, 1967 to Edwin H. Land and Howard G. Rogers, wherein at least two selectively sensitized photosensitive strata, superposed on a single support, are processed, simultaneously and without separation, with a single common image-receiving layer. A suitable arrangement of this type comprises a support carrying a red-sensitive silver halide emulsion stratum, a green-sensitive silver halide emulsion stratum and a blue-sensitive silver halide emulsion stratum, said emulsions having associated therewith, respectively, for example, a cyan dye developer, a magenta dye developer and a yellow dye developer. The dye developer may be utilized in the silver halide emulsion stratum, for example in the form of particles, or it may be disposed in a stratum behind the appropriate silver halide emulsion strata. Each set of silver halide emulsion and associated dye developer strata may be separated from other sets by suitable interlayers, for example, by a layer or stratum of gelatin or polyvinyl alcohol. In certain instances, it may be desirable to incorporate a yellow filter in front of the green-sensitive emulsion and such yellow filter may be incorporated in an interlayer. However, where desirable, a yellow dye developer of the appropriate spectral characteristics and present in a state capable of functioning as a yellow filter may be so employed and a separate yellow filter omitted.

Particularly useful products for obtaining multicolor dye developer images are disclosed in U.S. Pat. No. 3,415,644 issued Dec. 10, 1968 to Edwin H. Land. This patent discloses photographic products and processes wherein a photosensitive element and an image-receiving element are maintained in fixed relationship prior to exposure and this relationship is maintained as a laminate after processing and image formation. In these products, the final image is viewed through a transparent (support) element against a light-reflecting, i.e., white background. Photoexposure is made through said transparent element and application of the processing composition provides a layer of light-reflecting material to provide a white background. The light-reflecting material (referred to in said patent as an "opacifying agent") is preferably titanium dioxide, and it also performs an opacifying function, i.e., it is effective to mask the developed silver halide emulsions so that the transfer image may be viewed without interference therefrom, and it also acts to protect the photoexposed silver halide emulsions from post-exposure fogging by light passing through said transparent layer if the photoexposed film unit is removed from the camera before image-formation is completed.

U.S. Pat. No. 3,647,437, issued Mar. 7, 1972 to Edwin H. Land, is concerned with improvements in products and processed disclosed in said U.S. Pat. No. 3,415,644, and discloses the provision of light-absorbing materials to permit such processes to be performed, outside of the camera in which photoexposure is effected, under much more intense ambient light conditions. A light-absorbing material or reagent, preferably a pH-sensitive phthalein dye, is provided so positioned and/or constituted as not to interfere with photoexposure but so positioned between the photoexposed silver halide emulsions and the transparent support during processing after photoexposure as to absorb light which otherwise might fog the photoexposed emulsions. Furthermore, the light-absorbing material is so positioned and/or constituted after processing as not to interfere with viewing the desired image shortly after said image has been formed. In the preferred embodiments, the light-absorbing material, also sometimes referred to as an optical filter agent, is initially contained in the processing composition together with a light-reflecting material, e.g., titanium dioxide. The concentration of the light-absorbing dye is selected to provide the light transmission opacity required to perform the particular process under the selected light conditions.

In a particularly useful embodiment, the light-absorbing dye is highly colored at the pH of the processing composition, e.g., 13–14, but is substantially non-absorbing of visible light at a lower pH, e.g., less than 10–12. This pH reduction may be effected by an acid-reacting reagent appropriately positioned in the film unit, e.g., in a layer between the transparent support and the image-receiving layer.

The dye developers are preferably selected for their ability to provide colors that are useful in carrying out subtractive color photography, that is, the previously mentioned cyan, magenta and yellow. The dye developers employed may be incorporated in the respective silver halide emulsion or, in the preferred embodiment, in a separate layer behind the respective silver halide emulsion, and such a layer of dye developer may be applied by use of a coating solution containing the respective dye developer distributed, in a concentration calculated to give the desired coverage of dye developer per unit area, in a film-forming natural, or synthetic, polymer, for example, gelatin, polyvinyl alcohol, and the like, adapted to be permeated by the processing composition.

It has now been found that desirable improvements may be obtained in such dye developer color transfer processes if processing is effected in the presence of a 5- or 6-membered aromatic unsaturated heterocyclic diazole free of imino

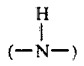

nitrogens and a liquid at room temperature. These heterocyclic diazoles may be said to be "aromatic", i.e., the 5-membered heterocyclic diazoles contain two double bonds and the 6-membered heterocyclic diazoles contain three double bonds. The nitrogen atoms may be adjacent or separated by one or two carbon atoms. Substituents on the ring carbons or nitrogens may include 1 to 2 carbon atoms. Examples of 5- and 6-membered unsaturated heterocyclic diazoles found useful in accordance with this invention include:

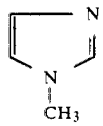

1-methyl imidazole

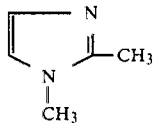

1,2-dimethyl imidazole

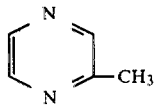

2-methyl pyrazine

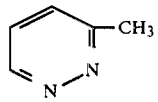

3-methyl pyridazine

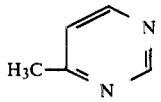

4-methyl pyrimidine

That these diazoles would be effective in this manner could not have been predicted, since such closely related compounds as the following compounds did not exhibit the same beneficial properties:

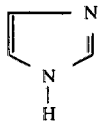

imidazole

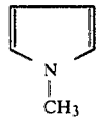

N-methyl pyrrole

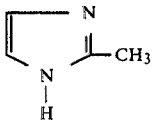

2-methyl-imidazole

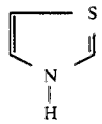

thiazolidine

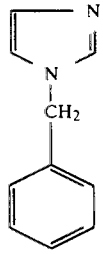

-continued 1-benzyl imidazole

While the reason why 1-methyl-imidazole should behave so differently from, e.g., imidazole or 2-methylimidazole is not fully understood, it is believed that the absence of an imino nitrogen

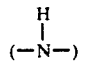

able to form an anion in alkaline solution is in some manner responsible for the different behaviour. 1-benzyl-imidazole, on the other hand is a solid at room temperature.

The following examples are given to illustrate the invention and are not intended to be limiting. All parts and percentages are by weight unless otherwise stated.

EXAMPLE 1

A multicolor photosensitive element using, as the cyan, magenta and yellow dye developers cyan:

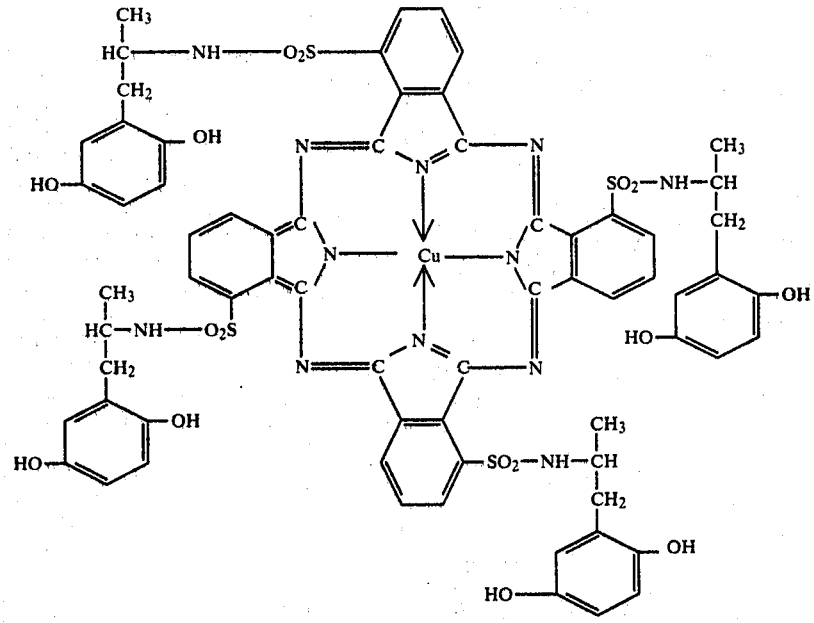

magenta:

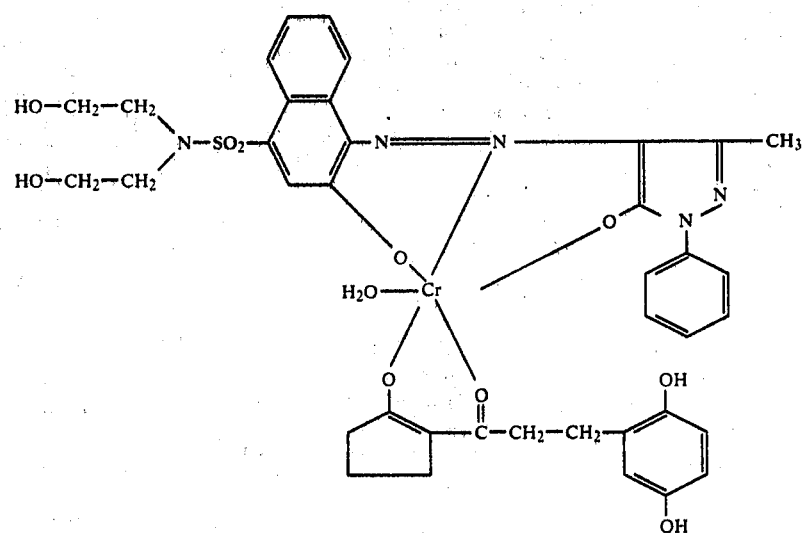

yellow:

-continued

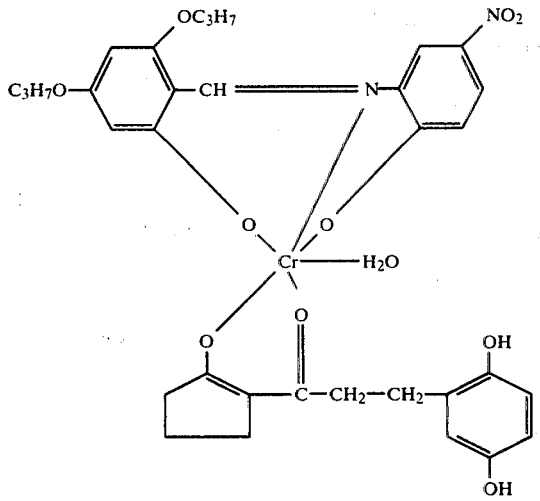

was prepared by coating a gelatin-subcoated 4 mil opaque polyethylene terephthalate film base with the following layers:

1. a layer of cyan dye developer dispersed in gelatin and coated at a converage of about 69 mg/ft$^2$ of dye and about 25 mg/ft$^2$ of gelatin, and also containing about 25 mg/ft$^2$ of 2-phenyl benzimidazole, and about 6.3 mg/ft$^2$ of 4'-methylphenyl hydroquinone;

2. a red-sensitive gelatino silver iodobromide emulsion coated at a coverage of about 120 mg/ft$^2$ of silver and about 72 mg/ft$^2$ of gelatin;

3. a layer of a 60-30-4-6 copolymer of butylacrylate, diacetone, acrylamide, styrene and methacrylic acid and polyacrylamide coated at a coverage of about 232.8 mg/ft$^2$ of the copolymer and about 7.2 mg/ft$^2$ of polyacrylamide;

4. a layer of magenta dye developer dispersed in gelatin and coated at a coverage of about 60 mg/ft$^2$ of dye and about 42 mg/ft$^2$ of gelatin, and also containing about 21 mg/ft$^2$ of 2-phenyl benzimidazole;

5. a green-sensitive gelatino silver iodobromide emulsion coated at a coverage of about 74 mg/ft$^2$ of silver and about 36 mg/ft$^2$ of gelatin;

6. a layer containing the copolymer referred to above in layer 3 and polyacrylamide coated at a coverage of about 127 mg/ft$^2$ of copolymer and about 8.1 mg/ft$^2$ of polyacrylamide, and about 6.6 mg/ft$^2$ of succinaldehyde;

7. a layer of yellow dye developer dispersed in gelatin and coated at a coverage of about 90 mg/ft$^2$ of dye and about 42 mg/ft$^2$ of gelatin, and also containing about 19 mg/ft$^2$ of 2-phenyl benzimidazole;

8. a blue-sensitive gelatino silver iodobromide emulsion layer including 4'-methylphenyl hydroquinone coated at a coverage of about 119 mg/ft$^2$ of silver, about 62 mg/ft$^2$ of gelatin and about 19 mg/ft$^2$ of 4'-methylphenyl hydroquinone; and 9. a layer of gelatin coated at a coverage of about 45 mg/ft$^2$ of gelatin and containing about 4 mg/ft$^2$ of carbon black.

A transparent 4 mil polyethylene terephthalate film base was coated, in succession, with the following layers to form an image-receiving component:

1. as a polymeric acid layer, a mixture of a partial butyl ester of polyethylene/maleic anhydride copolymer and polyvinyl butyral at a ratio of about 9:1 at a coverage of about 2,500 mg/ft$^2$;

2. a timing layer containing about a 45:0.7 ratio of a 60-30-4-6 copolymer of butylacrylate, diacetone acrylamide, styrene and methacrylic acid and polyvinyl alcohol at a coverage of about 45 mg/ft$^2$; and 3. an image-receiving layer containing a 2:1:1 mixture of polyvinyl alcohol, poly-4-vinyl pyridine and a graft copolymer of 4'-vinyl pyridine and vinylbenzyl trimethyl ammonium chloride on hydroxyethyl cellulose (2.2:1:2.2 ratio) at a coverage of about 300 mg/ft$^2$. The photosensitive component was photoexposed and then taped to one end of the image-receiving component with a rupturable container retaining an aqueous alkaline processing solution fixedly mounted on the leading edge of each of the components, by pressure-sensitive tapes to make a film unit, so that, upon application of compressive pressure to the container to rupture the container's marginal seal, its contents would be distributed between the image-receiving layer and the gelatin overcoat of the photosensitive component. The aqueous alkaline processing composition comprised:

| | | |
|---|---|---|
| Water | 100 | g. |
| Potassium hydroxide (85%) | 11 | g. |
| N-phenethyl-α-picolinium bromide | 3.12 | g. |
| Titanium dioxide | 77.8 | g. |
| 6-methyl uracil | 1.55 | g. |
| 3,5-dimethyl pyrazole | 0.405 | g. |
| Colloidal silica (30% $SiO_2$ dispersion) | 4.15 | g. |
| N-2-hydroxyethyl-N,N', N'-tris-carboxymethyl-ethylene diamine | 1.55 | g. |
| 4-aminopyrazolo-(3,4d)pyrimidine | 0.405 | g. |
| Carboxymethyl hydroxyethyl cellulose | 3.53 | g. |
| | 2.82 | g. |

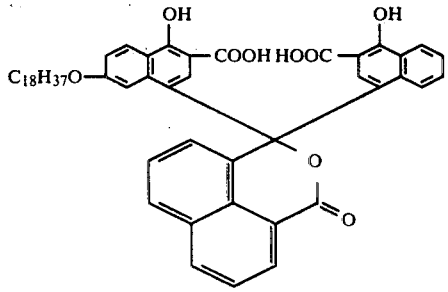

-continued

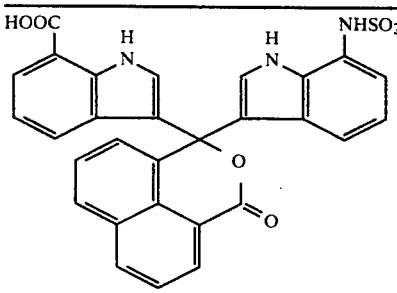

0.63 g.

A layer approximately 0.0030" thick of the processing composition was distributed by passing the film unit between a pair of pressure-applying rolls and into a lighted area. The resulting laminate was maintained intact to provide a multicolor integral negative-positive reflection print.

The above procedure was repeated except that 1-methyl imidazole was added to the processing composition at a concentration of about 1% by weight.

The maximum and minimum reflection densities of the neutral column of the control and test images were measured at intervals of time after the processing composition was applied, and the following results were obtained.

| | $D_{max}$ | | | $D_{min}$ | | |
|---|---|---|---|---|---|---|
| Control | Red | Green | Blue | Red | Green | Blue |
| 30 sec. | 0.65 | 0.63 | 1.37 | 0.46 | 0.45 | 0.47 |
| 60 sec. | 1.09 | 0.95 | 1.63 | 0.44 | 0.45 | 0.46 |
| 90 sec. | 1.49 | 1.28 | 1.81 | 0.42 | 0.45 | 0.45 |
| 120 sec. | 1.70 | 1.50 | 1.91 | 0.40 | 0.43 | 0.43 |
| 15 min. | 1.97 | 1.67 | 1.63 | 0.23 | 0.24 | 0.24 |
| 1-methyl imidazole | | | | | | |
| 30 sec. | 0.68 | 0.78 | 1.73 | 0.46 | 0.45 | 0.47 |
| 60 sec. | 1.09 | 1.15 | 2.04 | 0.44 | 0.45 | 0.46 |
| 90 sec. | 1.52 | 1.57 | 2.25 | 0.43 | 0.45 | 0.46 |
| 120 sec. | 1.70 | 1.80 | 2.33 | 0.41 | 0.45 | 0.45 |
| 15 min. | 1.83 | 1.95 | 2.21 | 0.25 | 0.26 | 0.26 |

It will be apparent that the inclusion of the 1-methyl imidazole resulted in faster dye transfer, particularly of the magenta dye developer. It will also be noted that the final minimum densities were substantially unchanged. (The decrease in minimum densities was due to the fact that early density readings necessarily included density contributed by the phthalein opacifying dyes prior to their decolorization.)

Good results with N-methyl imidazole also were obtained with the same film unit using higher concentrations, e.g., 1.75% and 2.5%. The substitution of 1,2-dimethyl imidazole for 1-methyl imidazole in the above experiment also gave increased transfer rates of unoxidized dye developer without adverse effect upon minimum density.

EXAMPLE 2

A photosensitive element was prepared similar to the one described in Example 1, using the same cyan and yellow dye developers and the following magenta dye developer:

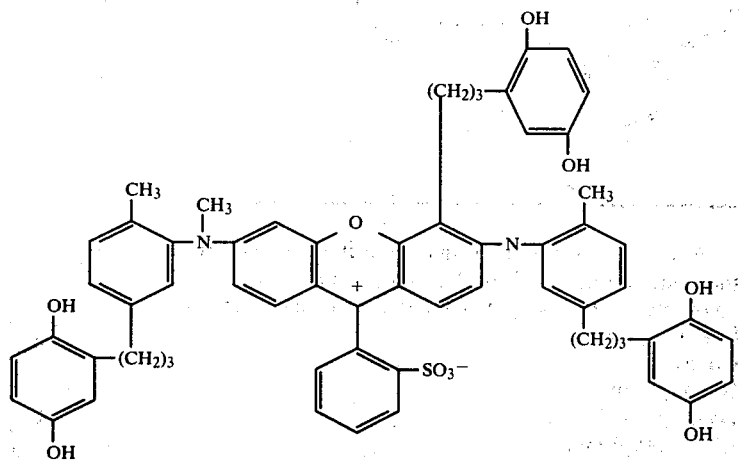

The coverages of the cyan, magenta and yellow dye developers, respectively, were on the order of 635, 645 and 920 mg./m$^2$. The 2-phenyl benzimidazole was replaced by N-dodecylamino-purine. A plurality of such photosensitive elements were given identical exposures and then processed in the manner described in Example 1 using the same type of image-receiving element with the following processing composition applied in a layer approximately 0.0030" (0.076 micron) thick, the processing composition comprising:

| | | |
|---|---|---|
| Water | 1642 | g. |
| Potassium hydroxide (45%) | 451.4 | g. |
| N-phenethyl-α-picolinium bromide (50%) | 102 | g. |
| Titanium dioxide | 2312 | g. |
| 6-methyl uracil | 20 | g. |
| 3,5-dimethyl pyrazole | 8 | g. |
| Colloidal silica (30% $SiO_2$ dispersion) | 37 | g. |
| N-2-hydroxyethyl-N,N',N'-tris-carboxymethyl-ethylene diamine | 30 | g. |
| 4-aminopyrazolo (3,4d)pyrimidine | 10 | g. |
| Polydiacetone acrylamide oxime | 451.8 | g. |
| Benzotriazole | 22 | g. |
| bis-(β-aminoethyl)-sulfide | 0.8 | g. |
| Polyethylene glycol (molecular weight about 4000) | 18 | g. |

-continued

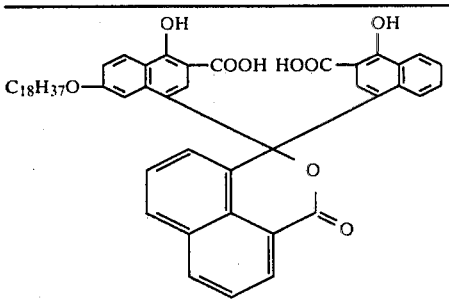

66.7 g.

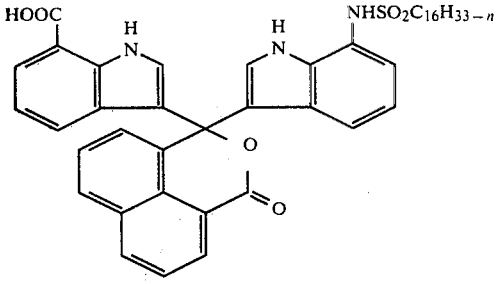

14 g.

Using the above processing composition as a control, the relative effects of the following compounds were compared at the weight percentages indicated in the following tables:

imidazole
2-methyl imidazole
1-methyl imidazole
1,2-dimethyl imidazole
2-methyl pyrazine
3-methyl pyridazine
4-methyl pyrimidine The following tables show the effects of the test compounds upon the final maximum red, green and blue reflection densities as measured in the neutral column:

| | Red | Green | Blue |
|---|---|---|---|
| Control | 1.82 | 2.03 | 1.92 |
| imidazole (1%) | 1.25 | 1.40 | 1.50 |
| imidazole (2%) | 1.13 | 1.35 | 1.49 |
| imidazole (3%) | 0.81 | 1.20 | 1.51 |
| 2-methyl imidazole (1%) | 1.41 | 1.65 | 1.85 |
| 2-methyl imidazole (2%) | 1.14 | 1.45 | 1.78 |
| 2-methyl imidazole (3%) | 0.94 | 1.27 | 1.74 |
| 1-methyl imidazole (1%) | 1.83 | 2.05 | 1.96 |
| 1-methyl imidazole (2%) | 1.81 | 2.07 | 2.07 |
| 1-methyl imidazole (3%) | 1.73 | 2.06 | 2.09 |
| 2-methyl pyrazine (1%) | 1.72 | 2.07 | 2.00 |
| 2-methyl pyrazine (2%) | 1.75 | 2.18 | 2.08 |
| 2-methyl pyrazine (3%) | 1.75 | 2.27 | 2.15 |
| 3-methyl pyridazine (1%) | 1.75 | 2.12 | 2.03 |
| 3-methyl pyridazine (2%) | 1.72 | 2.17 | 2.12 |
| 1,2-dimethyl imidazole (1%) | 1.51 | 1.85 | 2.06 |
| 1,2-dimethyl imidazole (2%) | 1.21 | 1.73 | 2.07 |
| 4-methyl pyrimidine (1%) | 1.75 | 2.06 | 2.04 |
| 4-methyl pyrimidine (2%) | 1.78 | 2.19 | 2.13 |

The relative rates of transfer of the image dyes was also measured using the same components and measured the density as a function of time using an automatic recording densitometer. The following table indicates the difference in density at the given times between the control and the test compound at 1 and 2% weight percent, decreased density at a given time being indicated by a minus sign.

| | ΔRed | | ΔGreen | | ΔBlue | |
|---|---|---|---|---|---|---|
| | 1% | 2% | 1% | 2% | 1% | 2% |
| imidazole | | | | | | |
| 60 seconds | −.14 | −.19 | −.16 | −.21 | −.09 | −.15 |
| 120 seconds | −.46 | −.66 | −.74 | −.82 | −.49 | −.55 |
| 180 seconds | −.76 | −.92 | −.96 | −1.04 | −.62 | −.65 |
| 2-methyl imidazole | | | | | | |
| 60 seconds | .04 | −.02 | −.04 | −.10 | .32 | .29 |
| 120 seconds | −.28 | −.48 | −.59 | −.76 | −.11 | −.18 |
| 180 seconds | −.56 | −.76 | −.79 | −.94 | −.14 | −.23 |
| 1-methyl imidazole | | | | | | |
| 60 seconds | .03 | −.01 | .21 | .26 | .43 | .49 |
| 120 seconds | .02 | −.13 | .10 | −.03 | .23 | .25 |
| 180 seconds | −.05 | −.28 | −.04 | −.21 | .18 | .15 |
| 2-methyl pyrazine | | | | | | |
| 60 seconds | .06 | .05 | .24 | .35 | .27 | .42 |
| 120 seconds | .05 | .04 | .15 | .18 | .18 | .21 |
| 180 seconds | .04 | .01 | .05 | .06 | .11 | .14 |
| 3-methyl pyridazine | | | | | | |
| 60 seconds | .01 | .04 | .30 | .43 | .41 | .56 |
| 120 seconds | .06 | .07 | .19 | .28 | .27 | .36 |
| 180 seconds | .06 | .03 | .06 | .11 | .23 | .28 |
| 1,2-dimethyl imidazole | | | | | | |
| 60 seconds | .08 | .05 | .26 | .39 | .51 | .63 |
| 120 seconds | .05 | −.02 | .13 | .26 | .37 | .42 |
| 180 seconds | −.07 | −.28 | 0 | .10 | .27 | .29 |
| 4-methyl pyrimidine | | | | | | |
| 60 seconds | .05 | .09 | .30 | .40 | .42 | .61 |
| 120 seconds | .05 | .12 | .20 | .35 | .34 | .51 |
| 180 seconds | .09 | .18 | .08 | .26 | .30 | .49 |

It will be seen from the experimental comparisons given above that incorporation of the diazoles within the scope of this invention are useful to increase the rate of transfer of one or more of the dye developers, particularly in the first minute or two, even though the final density may not be greater. In contrast, such closely related diazoles as imidazole and 2-methyl imidazole reduced transfer rates and substantially reduced final image densities.

The above examples illustrate how the diazoles within the scope of this invention may be utilized to modify the sensitometry in desirable aspects.

In the above examples the neutralizing and timing layers were positioned between the image-receiving layer and its transparent support. In certain embodiments it is advantageous to position the neutralizing and timing layer in the photosensitive element, i.e., between the cyan dye developer layer and the opaque support, in the manner described in U.S. Pat. No. 3,573,043 issued Mar. 30, 1971 to Edwin H. Land.

In the preferred embodiments the diazole is dissolved in the processing composition. The concentration of the diazole most appropriate for a given film unit may be determined by routine experimentation. In general, if the diazole is in the processing composition, the concentration may be in the range of about 0.5 to 3% by weight; higher concentrations may be used but have not been found to offer any advantages. The preferred concentration is about 0.5 to 1%.

It will be understood that the diazoles also may be used in dye developer color transfer processes wherein the image-receiving element is separated from the developed photosensitive element.

In certain instances the diazole, e.g., 1-methyl imidazole, may exhibit a tendency to photolyze and stain the image. Increasing the coverage of the polymeric acid neutralizing layer and/or placing it in the photosensitive element, has been found to substantially prevent such photolysis under typical normal conditions of use.

In a particularly useful embodiment of this invention, N-n-dodecylamino purine

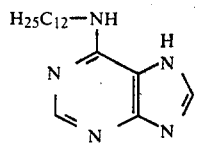

is incorporated in one or more of the dye developer layers. This combination together with some of the diazoles, e.g., 1-methyl imidazole, has been found to give an increase in red speed.

It will be recognized that it is desirable that the dye developers transfer as rapidly as possible. Efforts have therefore been made to increase the dye transfer rate by the addition of various chemicals, including chemicals which may be considered to be solvents for the dyes. While many compounds may increase the rate of transfer of unoxidized dye developer, few compounds will do this without also increasing the solubility and diffusibility of oxidized dye developer, i.e., dye developer which should be immobilized where development occurred. Such an increase in the diffusibility of oxidized dye developer is undesirable as it will result in unwanted dye transfer producing an increase in minimum density. This is a particular disadvantage in integral positive-negative relfection prints of the type described in the above-mentioned U.S. Pat. No. 3,415,644, since the processing composition is retained in the film and the "solvent" has an extended opportunity to cause unwanted dye transfer.

Since certain changes may be made in the above product and process without departing from the scope of the invention herein involved, it is intended that all matter contained in the above description shall be interpreted as illustrative and not in a limiting sense.

What is claimed is:

1. A diffusion transfer color process comprising exposing a photosensitive element comprising a support carrying at least one silver halide emulsion, each said silver halide emulsion having associated therewith a dye developer, and applying an aqueous alkaline processing composition to said exposed photosensitive element to effect development of exposed silver halide and an imagewise distribution of unoxidized dye developer is formed in undeveloped areas of said silver halide emulsion as a function of said development, said process including the step of transferring by diffusion at least a portion of said imagewise distribution of unoxidized dye developer to an image-receiving layer in superposed relationship with said silver halide emulsion, thereby providing a positive diffusion transfer dye image, said process being performed in the absence of a 5- or 6-membered aromatic unsaturated heterocyclic diazole free of imino nitrogen atoms, said diazole being a liquid at room temperature.

2. A diffusion transfer process as defined in claim 1 wherein said diazole is initially present in said processing composition.

3. A diffusion transfer process as defined in claim 2 wherein said diazole is 1-methyl imidazole.

4. A diffusion transfer process as defined in claim 2 wherein said diazole is 1,2-dimethyl imidazole.

5. A diffusion transfer process as defined in claim 2 wherein said diazole is 2-methyl pyrazine.

6. A diffusion transfer process as defined in claim 2 wherein said diazole is 3-methyl pyridazine.

7. A diffusion transfer process as defined in claim 2 wherein said diazole is 4-methyl pyrimidine.

8. A diffusion transfer color process as defined in claim 1 wherein said dye developer is:

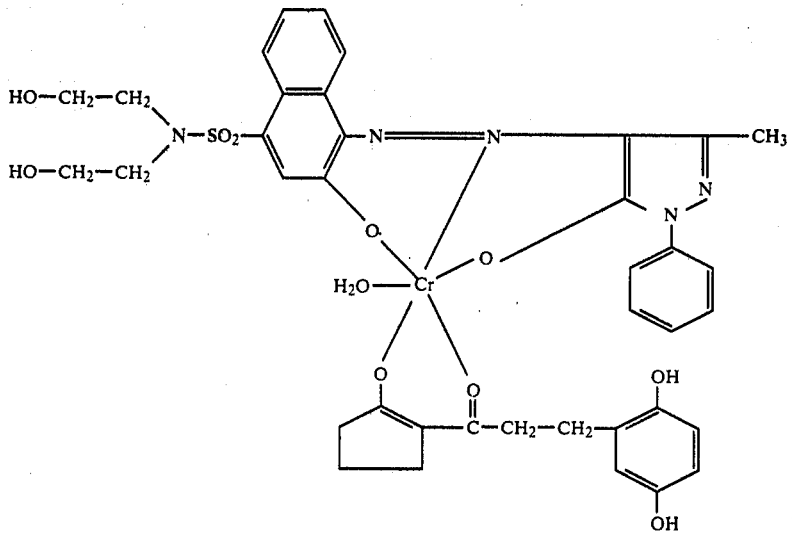

9. A diffusion transfer color process as defined in claim 1 wherein said dye developer is:

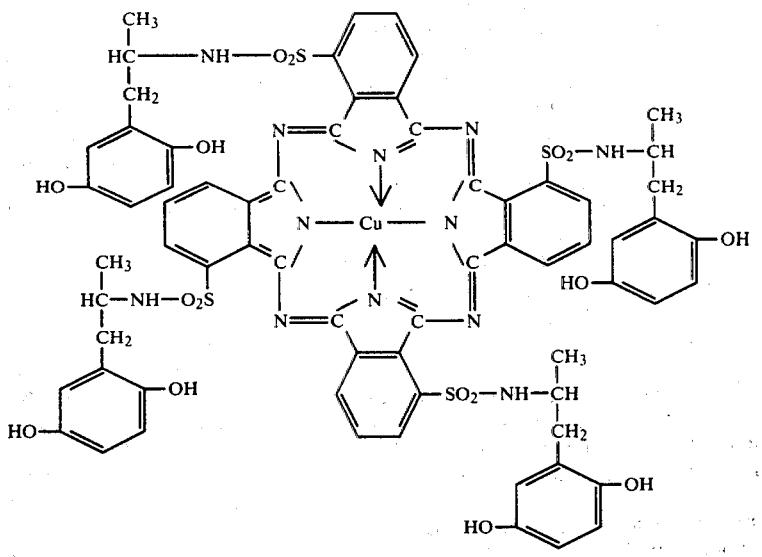

10. A diffusion transfer color process as defined in claim 1 wherein said photosensitive element includes a red-sensitive silver halide emulsion, a green-sensitive silver halide emulsion and a blue-sensitive silver halide emulsion, said silver halide emulsions having associated therewith, respectively, a cyan dye developer, a magenta dye developer and a yellow dye developer and said diffusion transfer image is a multicolor image.

11. A diffusion transfer film unit comprising a photosensitive element comprising a support carrying at least one photosensitive silver halide emulsion layer, each said silver halide emulsion layer having associated therewith a dye developer; an aqueous alkaline processing composition; an image-receiving layer in superposed or superposable relationship with said silver halide emulsion layer(s); said film unit including a 5- or 6-membered aromatic unsaturated heterocyclic diazole free of imino nitrogen atoms, said diazole being a liquid at room temperature.

12. A diffusion transfer film unit as defined in claim 11 wherein said photosensitive element includes a red-sensitive silver halide emulsion, a green-sensitive silver halide emulsion and a blue-sensitive silver halide emulsion, said silver halide emulsions having associated therewith, respectively, a cyan dye developer, a magenta dye developer and a yellow dye developer.

13. A diffusion transfer film unit as defined in claim 11 wherein said image-receiving layer is carried on a second, transparent support.

14. A diffusion transfer film unit as defined in claim 11 wherein said diazole is initially present in said processing composition.

15. A diffusion transfer film unit as defined in claim 14 wherein the concentration of said diazole is about 0.5 to 3% by weight.

16. A diffusion transfer film unit as defined in claim 15 wherein said concentration is about 0.5 to 1%.

17. A diffusion transfer film unit as defined in claim 11 wherein said diazole is 1-methyl imidazole.

18. A diffusion transfer film unit as defined in claim 11 wherein said diazole is 1,2-dimethyl imidazole.

19. A diffusion transfer film unit as defined in claim 11 wherein said diazole is 2-methyl pyrazine.

20. A diffussion transfer film unit as defined in claim 11 wherein said diazole is 3-methyl pyridazine.

21. A diffusion transfer film unit as defined in claim 11 wherein said diazole is 4-methyl pyrimidine.

* * * * *

UNITED STATES PATENT AND TRADEMARK OFFICE

CERTIFICATE OF CORRECTION

PATENT NO. : 4,282,306

DATED : August 4, 1981

INVENTOR(S) : Ronald F. Lambert

It is certified that error appears in the above-identified patent and that said Letters Patent are hereby corrected as shown below:

Column 14, line 19, "absence" should be --presence--.

Signed and Sealed this

First Day of June 1982

[SEAL]

*Attest:*

GERALD J. MOSSINGHOFF

*Attesting Officer*

*Commissioner of Patents and Trademarks*